US008151986B1

(12) United States Patent
Chen

(10) Patent No.: US 8,151,986 B1
(45) Date of Patent: Apr. 10, 2012

(54) TELESCOPING TOOL BOX

(76) Inventor: Kuan-Wei Chen, Taichung (TW)

( * ) Notice: Subject to any disclaimer, the term of this patent is extended or adjusted under 35 U.S.C. 154(b) by 0 days.

(21) Appl. No.: 13/038,647

(22) Filed: Mar. 2, 2011

(51) Int. Cl.
*B65D 85/20* (2006.01)
*B65D 6/00* (2006.01)

(52) U.S. Cl. ..... 206/379; 206/373; 220/4.31; 220/8

(58) Field of Classification Search ..... 206/372, 206/373, 378, 379; 220/4.06, 4.07, 4.21, 220/4.31, 4.32; 312/244, 902
See application file for complete search history.

(56) References Cited

U.S. PATENT DOCUMENTS 3,838,680 A * 10/1974 Shipman ..... 220/8
4,285,556 A * 8/1981 Loeffel ..... 312/244
5,160,026 A * 11/1992 Marsh ..... 206/373
6,581,774 B1 * 6/2003 Galafassi et al. ..... 206/379
7,780,000 B2 * 8/2010 Mazzucchelli ..... 220/8

* cited by examiner

*Primary Examiner* — Bryon Gehman
(74) *Attorney, Agent, or Firm* — Browdy and Neimark, PLLC

(57) ABSTRACT

A tool box includes: a first casing having a receiving space, a first horizontal slot and a first arcuate slot being formed on an outer face of a first left board section of the first casing, a second horizontal slot and a second arcuate slot being formed on an outer face of a first right board section of the first casing; a locating seat having multiple receiving holes and pivotally disposed in the receiving space; and a second casing. A first and a second raised sections are disposed on an inner face of a second left board section of the second casing. A third and a fourth raised sections are disposed on an inner face of a second right board section of the second casing. The first and second raised sections are engaged in the first horizontal slot and the third and fourth raised sections are engaged in the second horizontal slot.

1 Claim, 9 Drawing Sheets

TELESCOPING TOOL BOX

BACKGROUND OF THE INVENTION

1. Field of the Invention

The present invention relates generally to a hand tool, and more particularly to a tool box.

2. Description of the Related Art

A conventional tool box is used to receive different specifications and sizes of bits such as screwdriver bits or socket rods. The conventional tool box generally has a box body with a receiving space in which the bits are received, and a cover body for sealing the receiving space to prevent the bits from dropping out.

The above conventional tool box has a shortcoming. That is, it is inconvenient for a user to take out the bits for use.

SUMMARY OF THE INVENTION

It is therefore a primary object of the present invention to provide a tool box, which can be conveniently opened to expose the tools for a user to easily take out the tools.

To achieve the above and other objects, the tool box of the present invention includes: a first casing having a receiving space with an upper opening, a first horizontal slot and a first arcuate slot being formed on outer face of a first left board section of the first casing, a second horizontal slot and a second arcuate slot being formed on outer face of a first right board section of the first casing; a locating seat pivotally disposed in the receiving space of the first casing, multiple receiving holes being formed on the locating seat at intervals; and a second casing having a top board section, a second left board section, a second right board section and a second front board section. A first and a second raised sections are disposed on inner face of a second left board section of the second casing. A third and a fourth raised sections are disposed on inner face of a second right board section of the second casing. The first and second raised sections are engaged in the first horizontal slot and the third and fourth raised sections are engaged in the second horizontal slot.

The present invention can be best understood through the following description and accompanying drawings, wherein:

DETAILED DESCRIPTION OF THE PREFERRED EMBODIMENT

Figure 1:
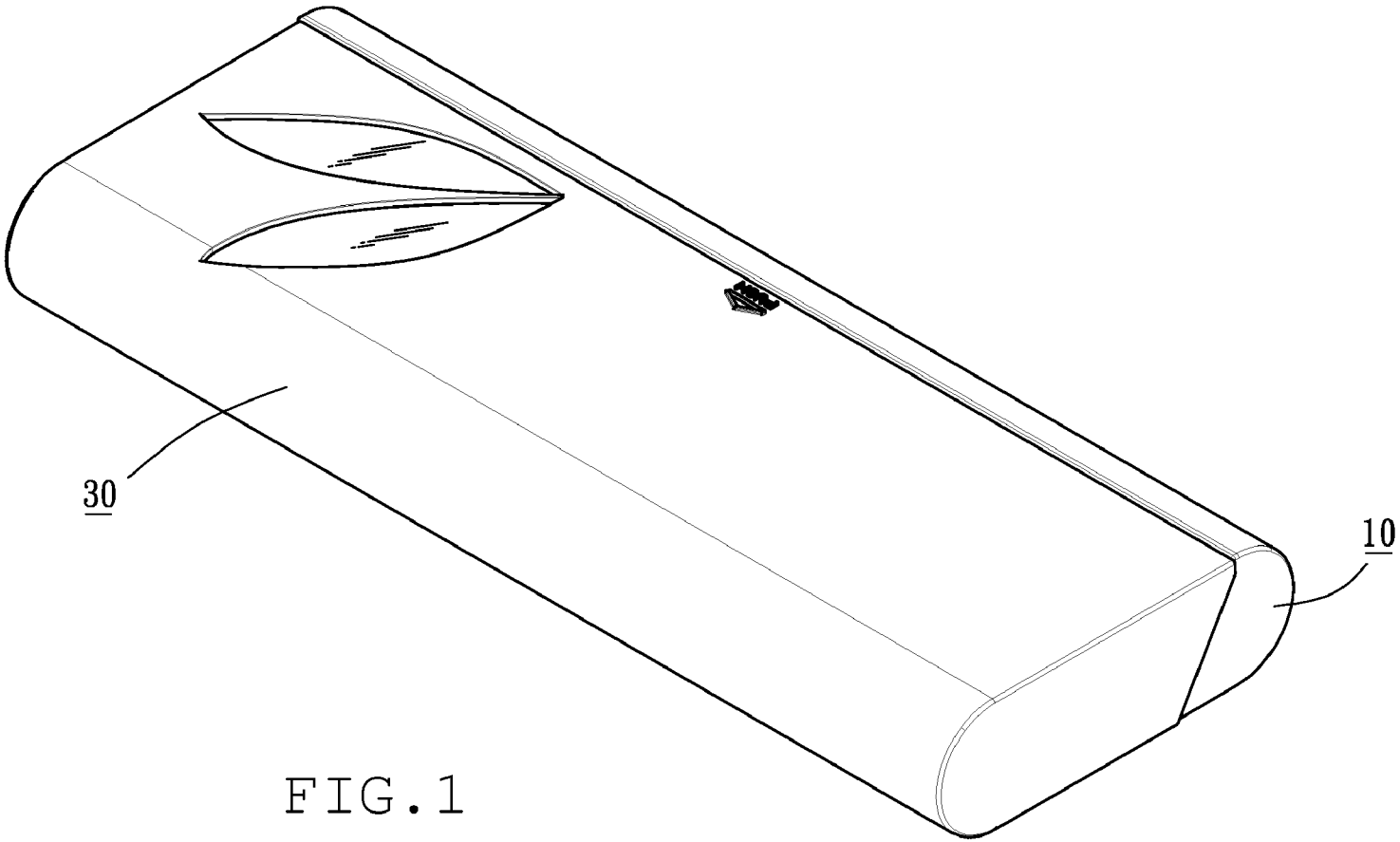
FIG. 1 is a perspective assembled view of the tool box of the present invention.
Figure 2:
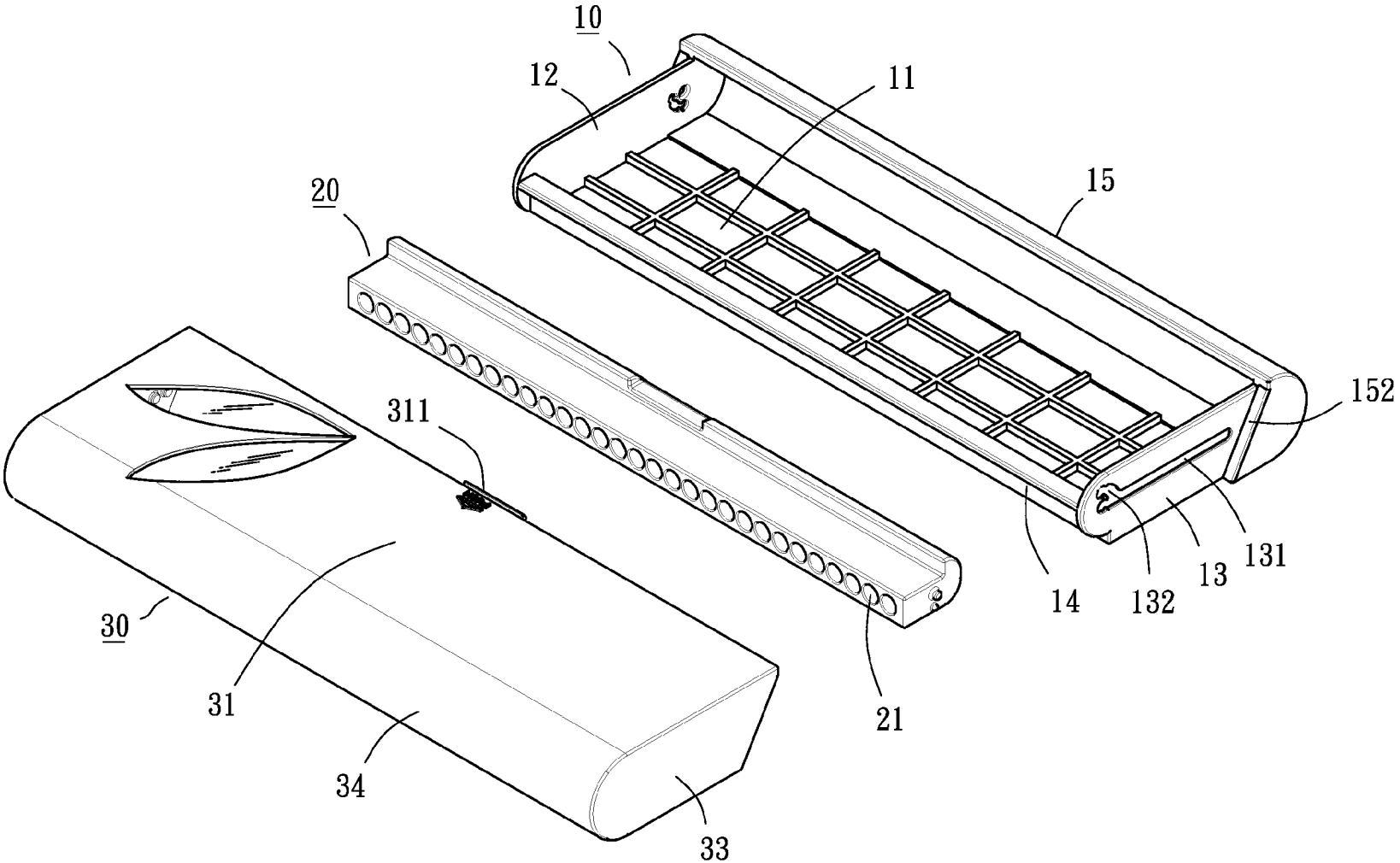
FIG. 2 is a perspective exploded view of the tool box of the present invention.
Figure 3:
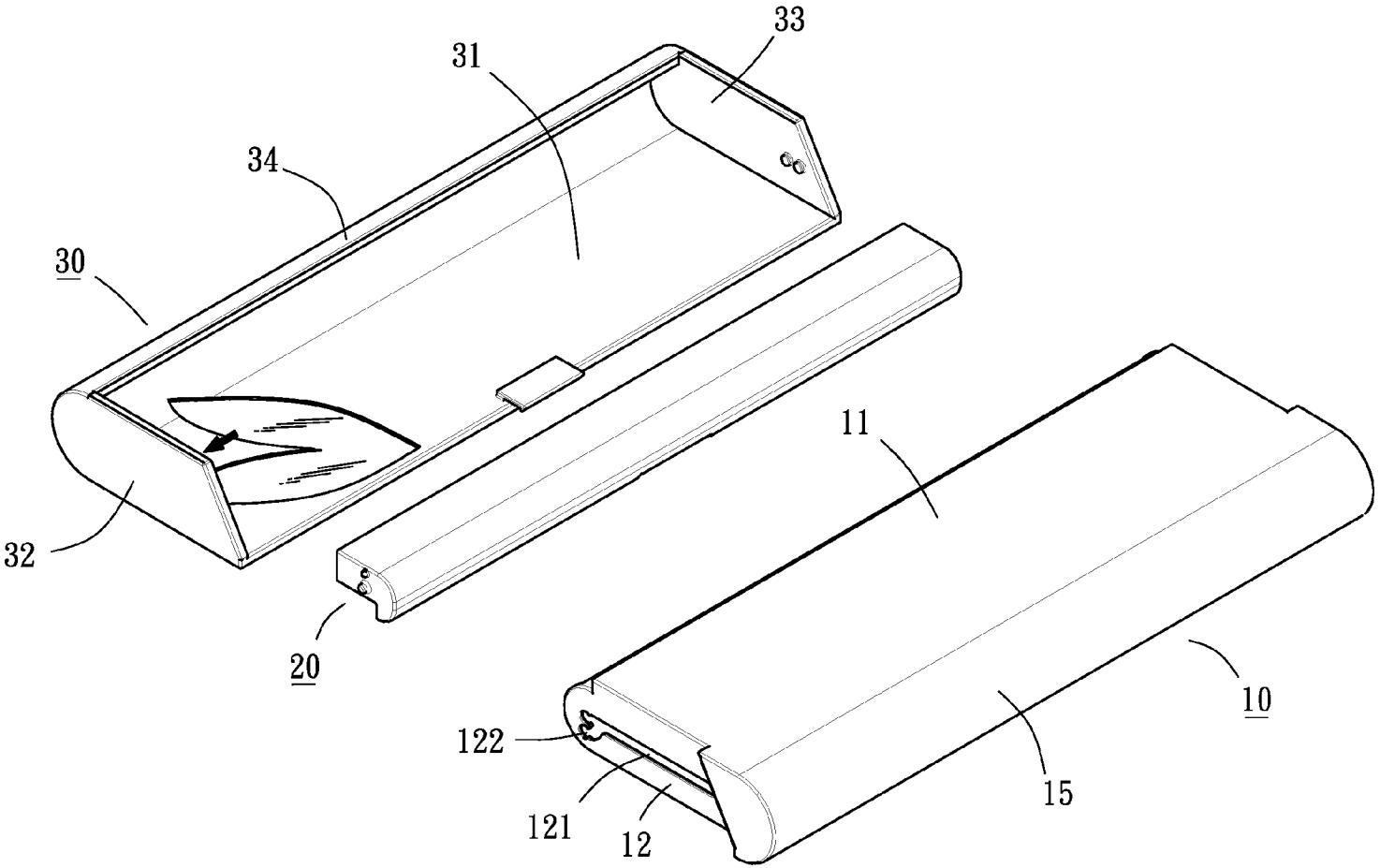
FIG. 3 is a perspective exploded view of the tool box of the present invention, seen in another direction.
Figure 4:
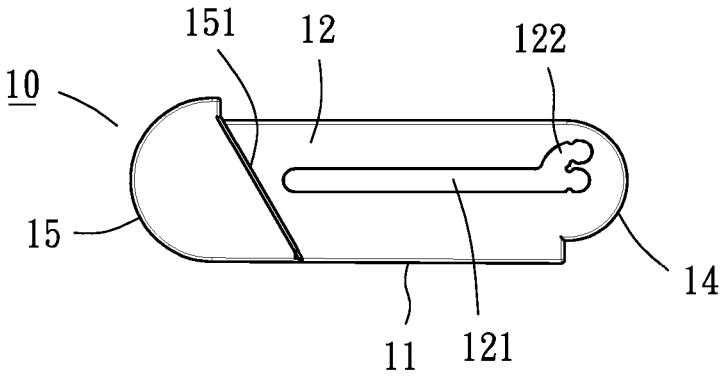
FIG. 4 is a left view of the first casing of the present invention.
Figure 5:
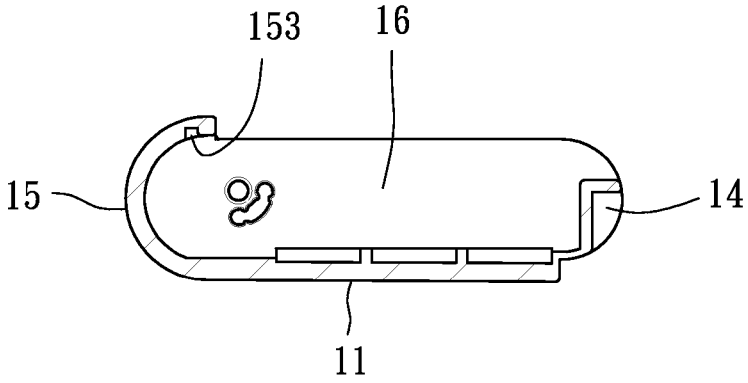
FIG. 5 is a sectional view of the first casing of the present invention.
Figure 6:
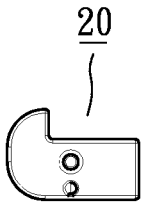
FIG. 6 is a left view of the locating seat of the present invention.
Figure 7:
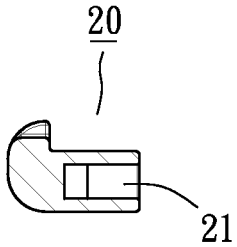
FIG. 7 is a sectional view of the locating seat of the present invention.
Figure 8:
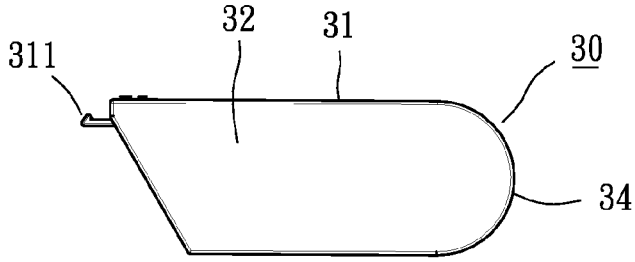
FIG. 8 is a left view of the second casing of the present invention.
Figure 9:
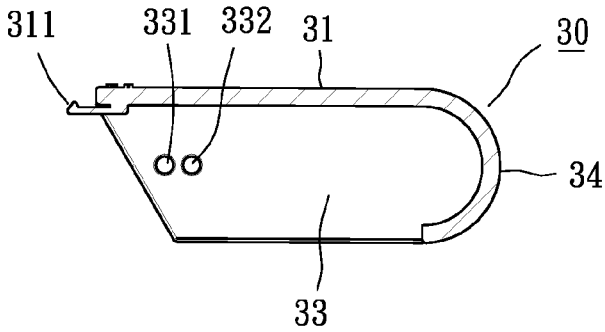
FIG. 9 is a sectional view of the second casing of the present invention.
Figure 10:
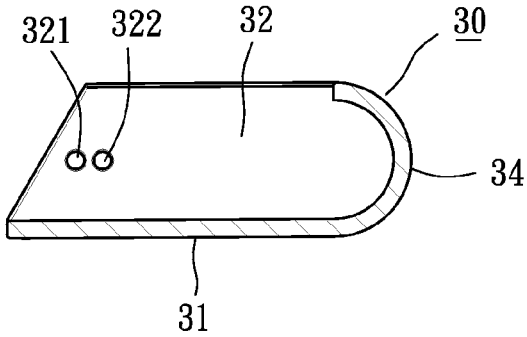
FIG. 10 is a sectional view of the second casing of the present invention, seen in a direction of the arrow of FIG. 3.
Figure 11:
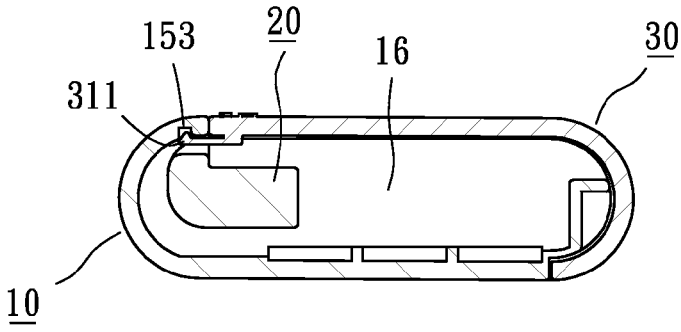
FIG. 11 is a sectional assembled view of the tool box of the present invention.
Figure 12:
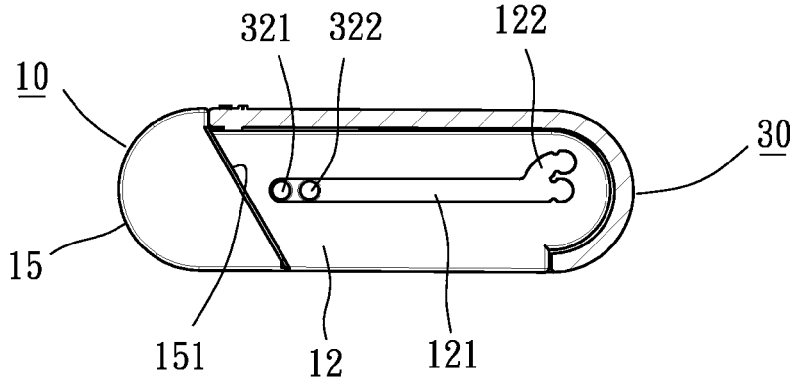
FIG. 12 is a sectional view showing the relationship between the first and second raised sections and the first horizontal slot.

Please refer to FIGS. 1 to 12. The tool box of the present invention includes a first casing 10 having a bottom board section 11, a first left board section 12 upward extending from a left side of the bottom board section 11, a first right board section 13 upward extending from a right side of the bottom board section 11, a first front board section 14 upward extending from a front side of the bottom board section 11 and a rear board section 15 upward extending from a rear side of the bottom board section 11. Left and right sides of the first front board section 14 are respectively connected with front sides of the first left board section 12 and the first right board section 13. Left and right sides of the rear board section 15 are respectively connected with rear sides of the first left board section 12 and the first right board section 13 to define a receiving space 16 with an upper opening. A first horizontal slot 121 is formed on an outer face of the first left board section 12. A first arcuate slot 122 further upward extends from a front section of the first horizontal slot 121. A second horizontal slot 131 is formed on an outer face of the first right board section 13. A second arcuate slot 132 further upward extends from a front section of the second horizontal slot 131. A first stop section 151 is formed on a left front side of the rear board section 15. A second stop section 152 is formed on a right front side of the rear board section 15 corresponding to the first stop section 151. In addition, an engagement hole 153 is formed on inner face of a top of the rear board section 15 in a predetermined position.

The tool box of the present invention further includes a locating seat 20 substantially in the form of a rectangular solid. A left side of the locating seat 20 is pivotally connected with a rear section of inner face of the first left board section 12 of the first casing 10. A right side of the locating seat 20 is pivotally connected with a rear section of inner face of the first right board section 13 of the first casing 10. Multiple receiving holes 21 are formed on a front face of the locating seat 20 at intervals.

The tool box of the present invention further includes a second casing 30 having a top board section 31, a second left board section 32 downward extending from a left side of the top board section 31, a second right board section 33 downward extending from a right side of the top board section 31 and a second front board section 34 downward extending from a front side of the top board section 31. Left and right sides of the second front board section 34 are respectively connected with front sides of the second left board section 32 and the second right board section 33. An engagement section 311 is disposed on the top board section 31 corresponding to the engagement hole 153 of the rear board section 15. A first raised section 321 is disposed on inner face of the second left board section 32 corresponding to the first horizontal slot 121 of the first left board section 12. A second raised section 322 is further disposed in front of the first raised section 321. A third raised section 331 is disposed on inner face of the second right board section 33 corresponding to the second horizontal slot 131 of the first right board section 13. A fourth raised section 332 is further disposed in front of the third raised section 331. The first and second raised sections 321, 322 are engaged in the first horizontal slot 121 and the third and fourth raised sections 331, 332 are engaged in the second horizontal slot 131. Then the second casing 30 is pushed forward to make the front side of the second left board section 32 abut against the first stop section 151 and make the front side of the second right board section 33 abut against the second stop section 152. Under such circumstance, the engagement section 311 is engaged in the engagement hole 153.

Figure 13:
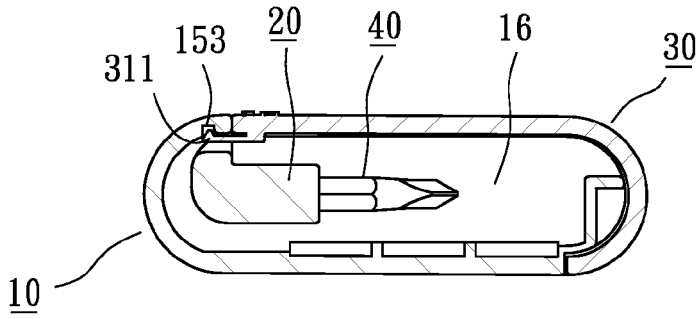
FIGS. 13 to 17 show the use of the tool box of the present invention.
Figure 14:
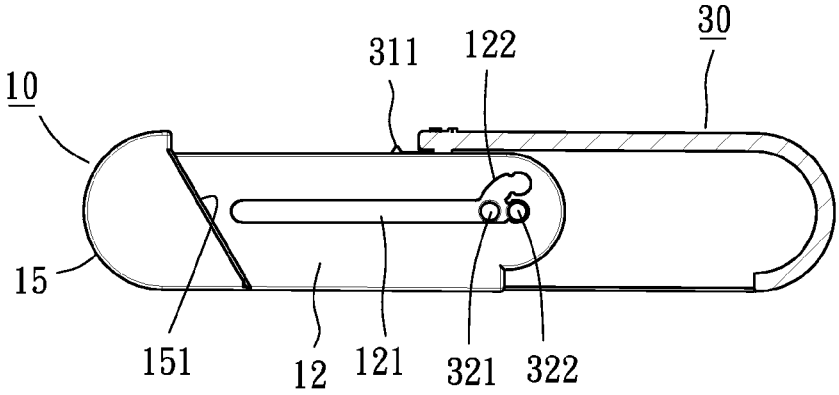
Figure 15:
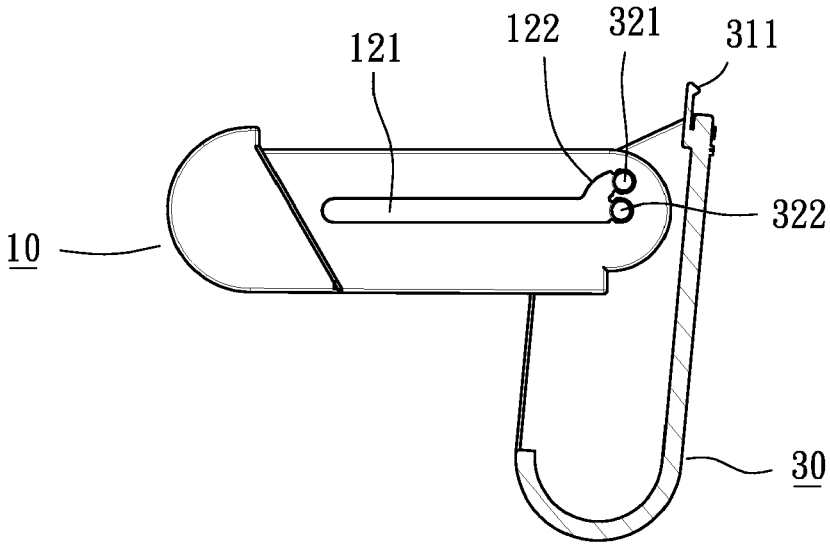
Figure 16:
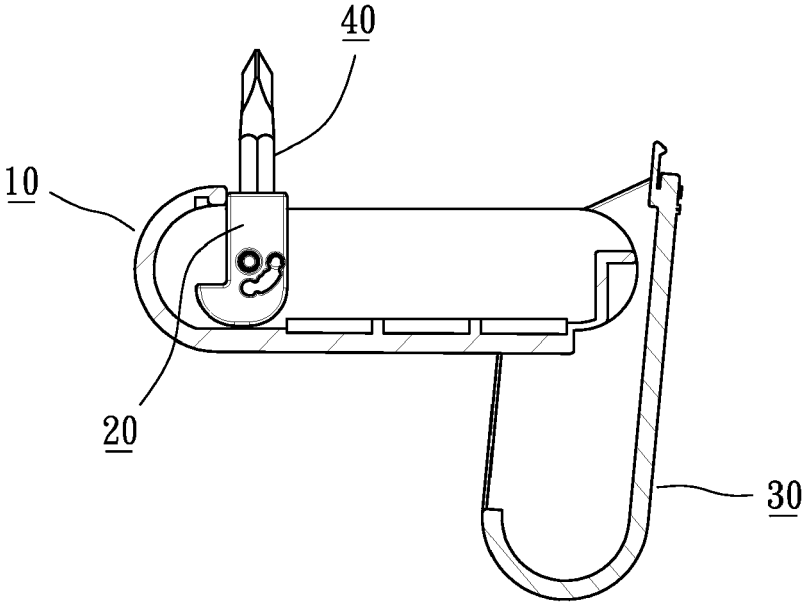
Figure 17:
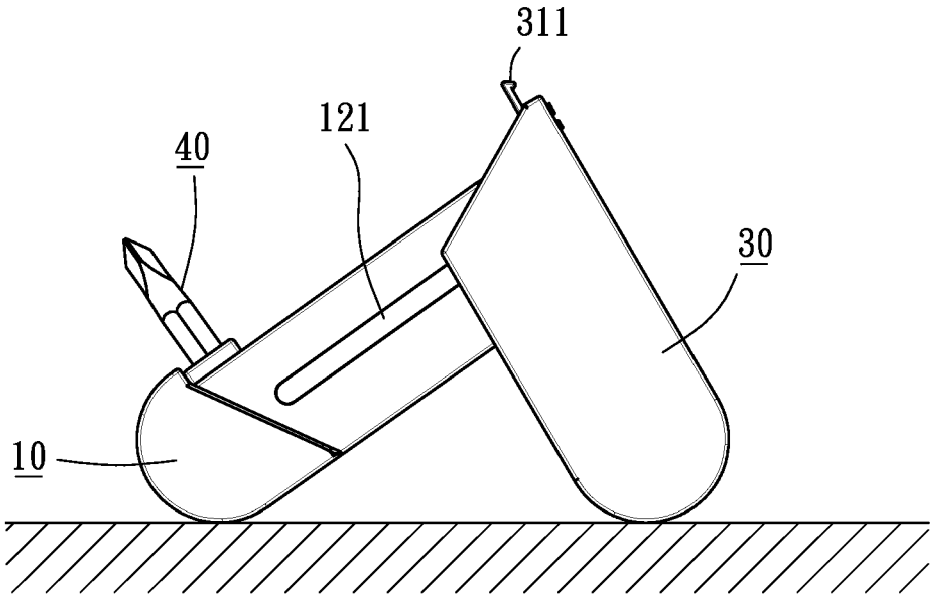

Please further refer to FIGS. 13 to 17, which show the use of the present invention. First, as shown in FIG. 13, different specifications and sizes of bits 40 can be respectively inserted in the receiving holes 21 of the locating seat 20. The bits 40 can be screwdriver bits or socket rods. A user can slightly apply a force to disengage the engagement section 311 from the engagement hole 153. Then, as shown in FIG. 14, the user can pull the second casing 30 forward until the second raised section 322 is positioned in a forefront end of the first horizontal slot 121. At this time, the four raised section 332 is positioned in a forefront end of the second horizontal slot 131. Then, as shown in FIG. 15, the second casing 30 is turned downward until the first raised section 321 is positioned in a forefront end of the first arcuate slot 122. At this time, the third raised section 331 is positioned in a forefront end of the second arcuate slot 132. Then, as shown in FIG. 16, the locating seat 20 is turned upward into an erect state. Alternatively, the tool box of the present invention can be placed on a table face or any other plane face for a worker to conveniently take out the bits 40.

Figure 18:
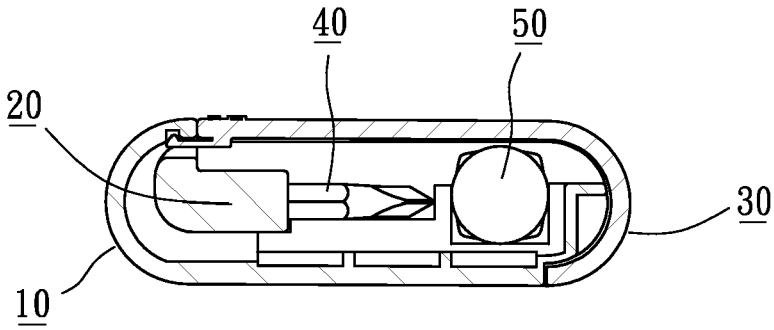
FIG. 18 is a sectional view showing that a screwdriver is placed in the receiving space of the present invention.

Referring to FIG. 18, a screwdriver 50 can be placed in the receiving space 16 of the tool box to facilitate the work.

The above embodiment is only used to illustrate the present invention, not intended to limit the scope thereof. Many modifications of the above embodiment can be made without departing from the spirit of the present invention.

What is claimed is:

1. A tool box comprising:

a first casing having a bottom board section, a first left board section upward extending from a left side of the bottom board section, a first right board section upward extending from a right side of the bottom board section, a first front board section upward extending from a front side of the bottom board section and a rear board section upward extending from a rear side of the bottom board section, left and right sides of the first front board section being respectively connected with front sides of the first left board section and the first right board section, left and right sides of the rear board section being respectively connected with rear sides of the first left board section and the first right board section to define a receiving space with an upper opening, a first horizontal slot being formed on an outer face of the first left board section, a first arcuate slot extending upwardly from a front section of the first horizontal slot, a second horizontal slot being formed on an outer face of the first right board section, a second arcuate slot extending upwardly from a front section of the second horizontal slot, a first stop section being formed on a left front side of the rear board section, a second stop section being formed on a right front side of the rear board section corresponding to the first stop section, an engagement hole being formed on an inner face of a top of the rear board section in a predetermined position;

a locating seat substantially in the form of a rectangular solid, a left side of the locating seat being pivotally connected with a rear section of an inner face of the first left board section of the first casing, a right side of the locating seat being pivotally connected with a rear section of an inner face of the first right board section of the first casing, and multiple receiving holes being formed on a front face of the locating seat at intervals; and a second casing having a top board section, a second left board section downward extending from a left side of the top board section, a second right board section downward extending from a right side of the top board section and a second front board section downward extending from a front side of the top board section, left and right sides of the second front board section being respectively connected with front sides of the second left board section and the second right board section, an engagement section being disposed on the top board section corresponding to the engagement hole of the rear board section, a first raised section being disposed on the inner face of the second left board section corresponding to the first horizontal slot of the first left board section, a second raised section being further disposed in front of the first raised section, a third raised section being disposed on the inner face of the second right board section corresponding to the second horizontal slot of the first right board section, a fourth raised section being further disposed in front of the third raised section, the first and second raised sections being engaged in the first horizontal slot and the third and fourth raised sections being engaged in the second horizontal slot, the second casing being pushed forward to make the front side of the second left board section abut against the first stop section and make the front side of the second right board section abut against the second stop section with the engagement section engaged in the engagement hole.

* * * * *